US011255113B2

(12) United States Patent
Saitou et al.

(10) Patent No.: US 11,255,113 B2
(45) Date of Patent: Feb. 22, 2022

(54) OUTER HANDLE DEVICE FOR VEHICLE DOOR

(71) Applicant: KABUSHIKI KAISHA HONDA LOCK, Miyazaki (JP)

(72) Inventors: Yasuhiro Saitou, Miyazaki (JP); Tatsuya Ooyama, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 736 days.

(21) Appl. No.: 16/046,588

(22) Filed: Jul. 26, 2018

(65) Prior Publication Data

US 2019/0234123 A1 Aug. 1, 2019

(30) Foreign Application Priority Data

Jan. 26, 2018 (JP) ..... JP2018-011349

(51) Int. Cl.
*E05B 85/16* (2014.01)
*E05B 77/36* (2014.01)

(52) U.S. Cl.
CPC ..... *E05B 85/16* (2013.01); *E05B 77/36* (2013.01)

(58) Field of Classification Search
CPC ..... E05B 85/16; E05B 77/36; E05B 85/14
See application file for complete search history.

(56) References Cited

U.S. PATENT DOCUMENTS 6,363,577 B1 * 4/2002 Spitzley ..... E05B 79/06 16/438
7,559,120 B2 7/2009 Fujiwara et al.
(Continued)

FOREIGN PATENT DOCUMENTS

CN 101275444 A 10/2008
CN 101294458 A 10/2008
(Continued)

OTHER PUBLICATIONS

Official Communication (International Search Report and Written Opinion) issued in the corresponding International Patent Application PCT/JP2018/035597.
(Continued)

*Primary Examiner* — Kristina R Fulton
*Assistant Examiner* — James Edward Ignaczewski
(74) *Attorney, Agent, or Firm* — Carrier Blackman & Associates, P.C.; William D. Blackman; Joseph P. Carrier

(57) ABSTRACT

An outer handle device for a vehicle door includes: a base mounted on an outer panel from an inside of the outer panel; an operating handle disposed on an outside of the outer panel and having a support shaft that extends along a swing axis on a support arm part entering the inside of the outer panel from the outside thereof; and a support member that is fitted to the base, engages with the support shaft from a rear, makes a front end of the support arm part abut against an abutment receiving part while the operating handle is swinging, and restrains displacement of the support shaft toward the outer panel. The base is provided with a restricting part that makes contact with the support arm part when the operating handle swings, thus restricting displacement of the operating handle in moving away inwardly from the outer panel.

14 Claims, 9 Drawing Sheets

(56) References Cited

U.S. PATENT DOCUMENTS

| | | | | |
|---|---|---|---|---|
| 8,777,281 | B2 * | 7/2014 | Saitou | E05B 79/06 292/336.3 |
| 8,991,880 | B2 | 3/2015 | Yokoyama et al. | |
| 9,228,380 | B2 | 1/2016 | Gerber | |
| 9,605,451 | B2 | 3/2017 | Patel | |
| 2008/0088139 | A1 * | 4/2008 | Sunahara | E05B 85/16 292/336.3 |
| 2013/0161964 | A1 * | 6/2013 | Ishida | E05B 83/40 292/336.3 |
| 2014/0265373 | A1 * | 9/2014 | Patel | E05B 85/16 292/336.3 |

FOREIGN PATENT DOCUMENTS

| | | | | |
|---|---|---|---|---|
| EP | 2980343 | A1 * | 2/2016 | E05B 85/16 |
| JP | 2006-037378 | A | 2/2006 | |
| JP | 2008-013960 | A | 1/2008 | |
| JP | 5153742 | B2 | 2/2013 | |
| JP | 2013-112986 | A | 6/2013 | |
| JP | 2016-199937 | A | 12/2016 | |
| JP | 2016199937 | A * | 12/2016 | |

OTHER PUBLICATIONS

Official Communication dated Dec. 28, 2020 issued over the corresponding Chinese Patent Application No. 201880087500.X.

* cited by examiner

OUTER HANDLE DEVICE FOR VEHICLE DOOR

CROSS REFERENCE TO RELATED APPLICATIONS

The present application claims priority under 35 U.S.C. § 119 to Japanese Patent Application No. 2018-11349 filed Jan. 26, 2018 the entire contents of which are hereby incorporated by reference.

BACKGROUND OF THE INVENTION

Field of the Invention

The present invention relates to an outer handle device for a vehicle door that includes a base that is mounted on an outer panel of the vehicle door from an inside of the outer panel, an operating handle that is disposed on an outside of the outer panel and has a support shaft extending along a swing axis on a support arm part entering the inside of the outer panel from the outside of the outer panel, and a support member that is fitted to the base, engages with the support shaft of the operating handle from a rear, makes a front end of the support arm part abut against an abutment receiving part while the operating handle is swinging, and restrains displacement of the support shaft toward the outer panel.

Description of the Related Art

Japanese Patent No. 5153742 discloses an outer handle device for a vehicle door in which rattling of an operating handle in the fore-and-aft direction of the vehicle is suppressed by a support arm part abutting against a fitting part and an abutment receiving part of a support member when the operating handle is operated so as to move away outwardly from an outer panel.

In the outer handle device described in Japanese Patent No. 5153742, when the operating handle is operated so as to move away outwardly from the outer panel, if a force directed inward of the outer panel acts on the support arm part of the operating handle, the support arm part will be displaced inward of the outer panel; as a result a gap will occur in the fore-and-aft direction of the vehicle between the front end of the support arm part and the support member, and there is a possibility that the operating handle will rattle.

SUMMARY OF THE INVENTION

The present invention has been accomplished in light of the above circumstances, and it is an object thereof to provide an outer handle device for a vehicle door that can more reliably prevent an operating handle from rattling.

In order to achieve the object, according to a first aspect of the present invention, there is provided an outer handle device for a vehicle door comprising a base that is mounted on an outer panel of the vehicle door from an inside of the outer panel, an operating handle that is disposed on an outside of the outer panel and has a support shaft extending along a swing axis on a support arm part entering the inside of the outer panel from the outside of the outer panel, and a support member that is fitted to the base, engages with the support arm part from a rear side of the support arm part, and retains displacement of the operating handle in at least a vehicle fore-and-aft direction, the base being provided with a restricting part that makes contact with the support arm part when the operating handle swings, thus restricting displacement of the operating handle in moving away inwardly from the outer panel.

In accordance with the first aspect, when the operating handle is operated so as to move away outwardly from the outer panel, even if a force directed inward of the outer panel acts on the support arm part of the operating handle, since displacement of the support arm part is supported by the restricting part, rattling of the operating handle can reliably be prevented.

According to a second aspect of the present invention, in addition to the first aspect, the restricting part is formed integrally with the base so as to face the outer panel and is in contact with a restricting face formed on the support shaft.

In accordance with the second aspect, since the restricting part is formed integrally with the base, addition of another member is not required for installing the restricting part, and any increase in the number of components can be avoided.

According to a third aspect of the present invention, in addition to the second aspect, the base comprises a pair of support side walls that are disposed on opposite sides of the support member and support the support member so as to be swingable between a standby position and an assembled position, a pair of front and rear linking bodies that are disposed across a gap therebetween in a fore-and-aft direction and connect the support side walls to each other, and a reinforcing body that connects the linking bodies to each other and supports the restricting part.

In accordance with the third aspect, since support of the restricting part is reinforced by the reinforcing body, it is possible to prevent the restricting part from being broken.

DESCRIPTION OF THE PREFERRED EMBODIMENT

One embodiment of the present invention is explained below by reference to the attached drawings. In the explanation below, the fore-and-aft direction corresponds to the fore-and-aft direction of the vehicle.

Figure 1:
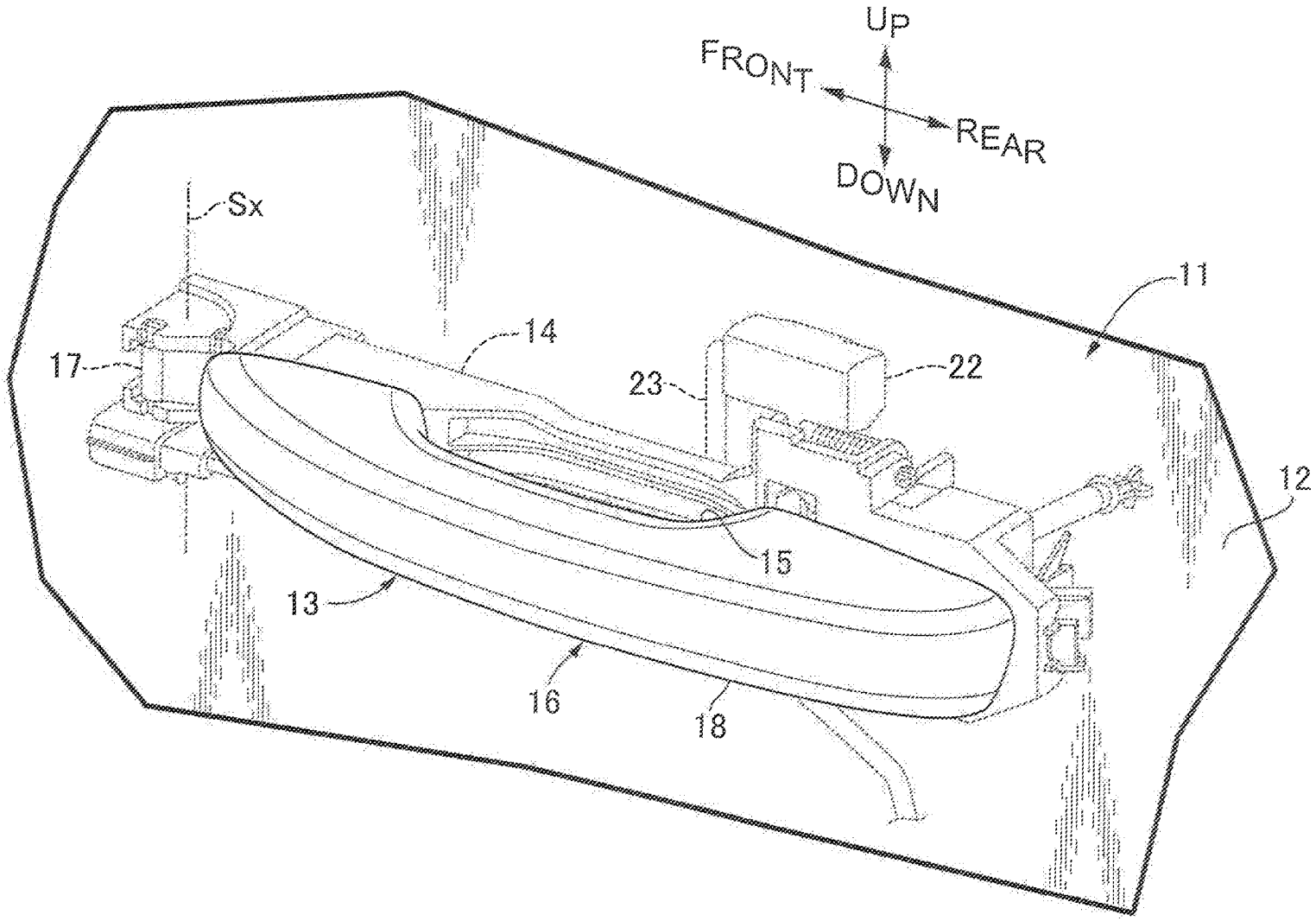
FIG. 1 is a perspective view schematically showing the appearance of an outer handle device related to one embodiment of the present invention.
Figure 5:
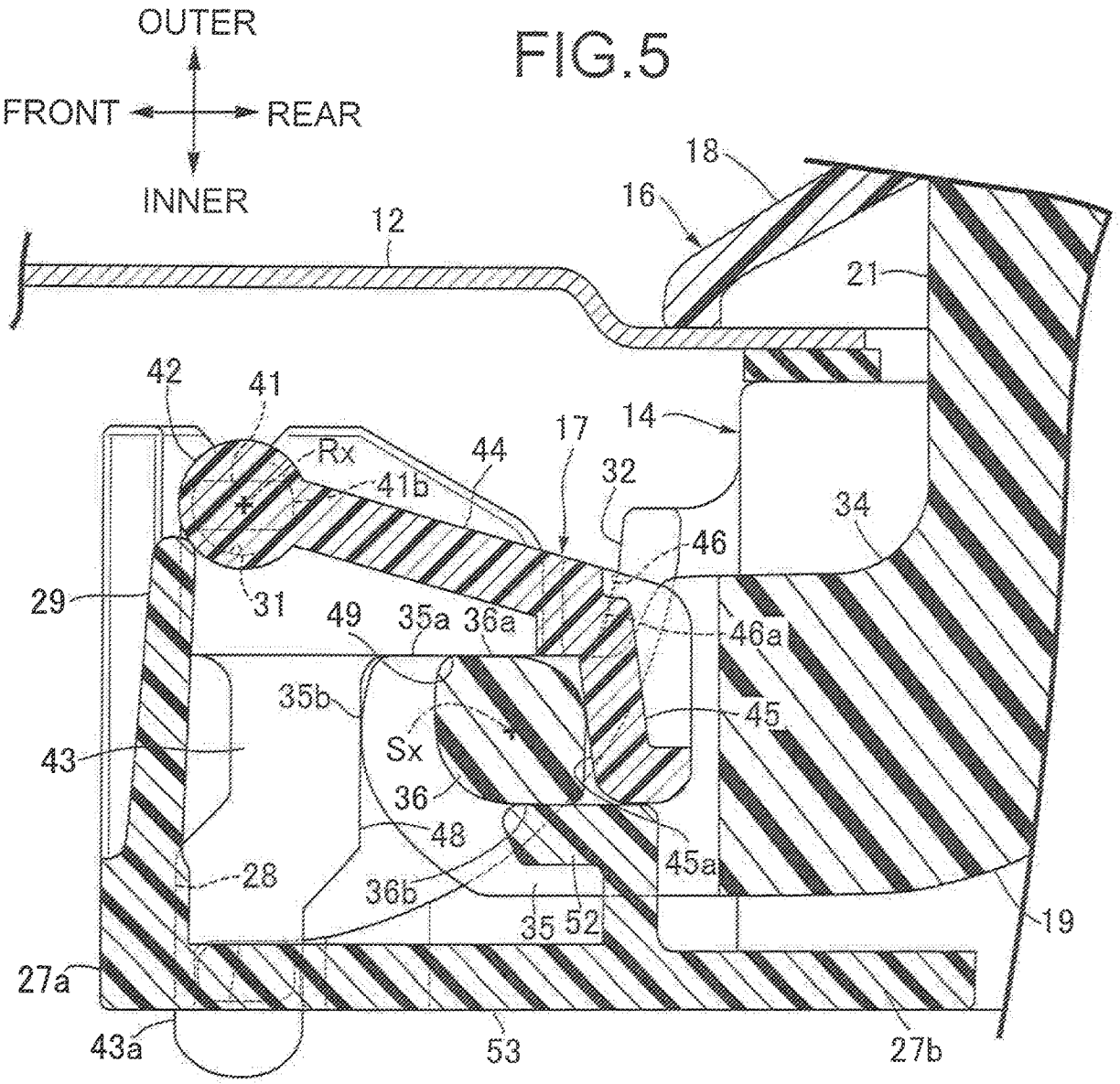
FIG. 5 is an enlarged horizontal sectional view schematically showing the support arm part linked to the base via the support member.

FIG. 1 schematically shows the appearance of an outer handle device related to one embodiment of the present invention. An outer handle device 13 is mounted on an outer panel 12 of a vehicle door 11, which is for example a side door of a passenger vehicle, and the outer handle device 13 includes a base 14 that is mounted on the outer panel 12 from the inside of the outer panel 12, an operating handle 16 that is disposed on the outside of the outer panel 12, extends in the fore-and-aft direction of the vehicle, forms a space 15 that receives at least four fingers of an operator from the vertical direction between the operating handle 16 and an outer face of the outer panel 12, and is gripped by a hand of the operator, and a support member 17 that is mounted on the base 14 and links the front end of the operating handle 16 to the base 14 so as to be relatively rotatable around a swing axis Sx of the operating handle 16 with respect to the base 14. The operating handle 16 has a handle cover 18 that is formed from a synthetic resin and is decorated for example in the same manner as for the outer panel 12 so as to be integrated with the outer panel 12, and a handle main body 21 that, as shown in FIG. 5, is formed from a synthetic resin, is housed inside the handle cover 18, extends in the fore-and-aft direction of the vehicle, and is linked to the base 14 via a support arm part 19 at the front end.

As shown in FIG. 1, the rear end of the handle main body 21 extends through the base 14 and protrudes into the outer panel 12. A lever 22 relatively rotatably supported on the base 14 is linked to the rear end of the handle main body 21. A rod 23 linked to a door lock device, which is not illustrated, is linked to the lever 22, and a pulling force acts on the rod 23 in response to a swing operation of the operating handle 16. The operating handle 16 swings around the swing axis Sx between a non-operated position in which it is in contact with an outer face of the outer panel 12 and an operated position in which it moves away outwardly from the outer face of the outer panel 12. When the operating handle 16 swings toward the outside up to the operated position, the door lock device is released, and the vehicle door 11 is opened.

Figure 2:
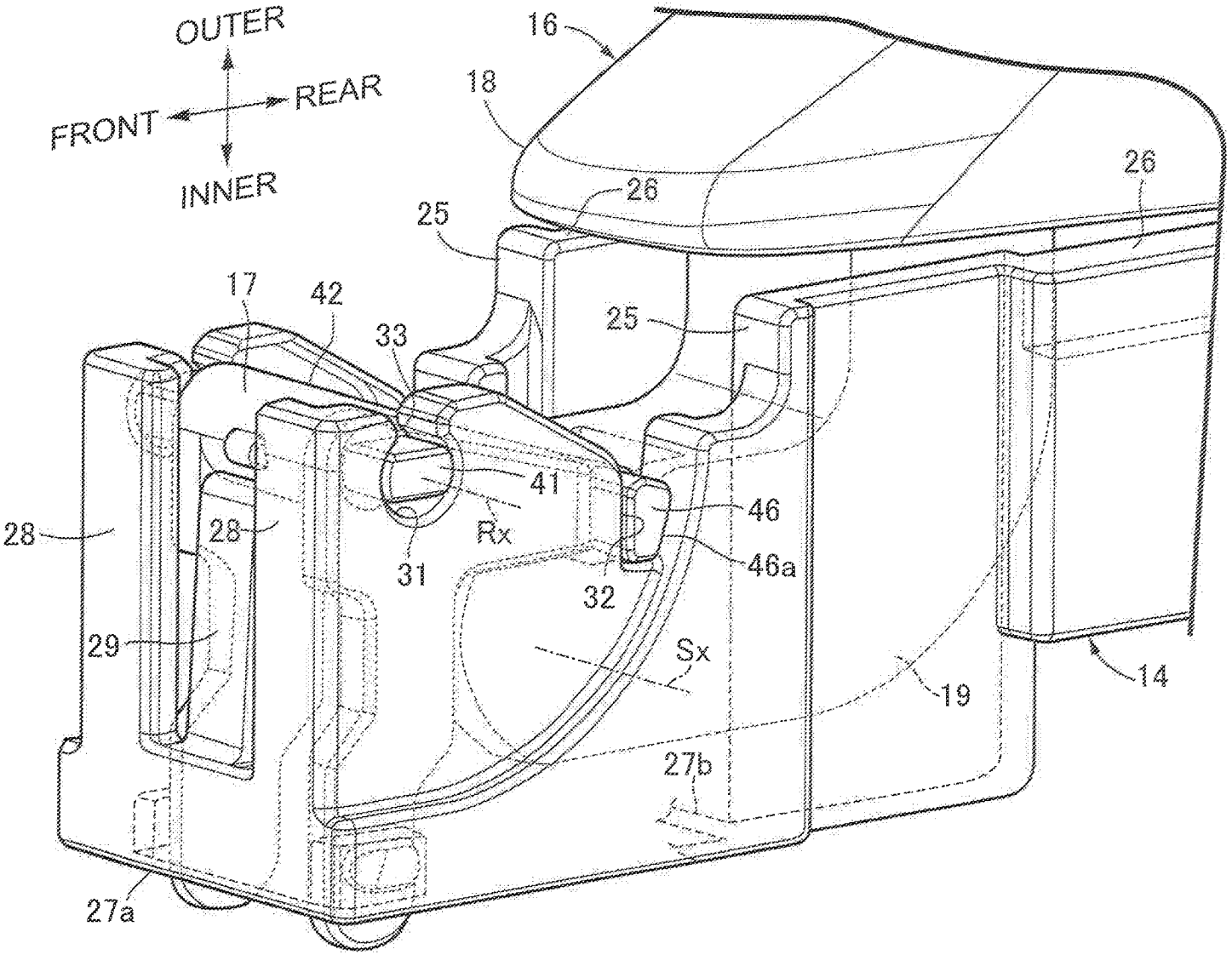
FIG. 2 is an enlarged perspective view schematically showing the structure of a base of the outer handle device.

As shown in FIG. 2, the base 14 includes a pair of support side walls 25 extending in parallel with each other across a predetermined gap (sandwiching a housing space for the support arm part 19) in front of the space 15. Formed on each of the support side walls 25 is a reference plane 26 that is formed from a plane extending equidistant from the handle cover 18 in parallel with the swing axis Sx and abuts against an inner face of the outer panel 12. The outer panel 12 is sandwiched between the base 14 pressed against the inner face of the outer panel 12 via the reference plane 26 and the handle cover 18 contacting the outer face of the outer panel 12 at the non-operated position.

A pair of front and rear linking bodies 27*a* and 27*b* are provided at the front end of the base 14 in front of the reference plane 26, the pair of front and rear linking bodies 27*a* and 27*b* being disposed with a gap therebetween in the fore-and-aft direction and connecting the support side walls 25 to each other at a position separated from the outer panel 12. Joined integrally to the linking body 27*a* on the front side are a pair of front walls 28 that are individually continuous from the front end of the support side wall 25 and extend between the outer panel 12 and the linking body 27*a* while having a gap therebetween, and an elastic wall 29 that is continuous from the linking body 27*a* between the two front walls 28 and extends from the linking body 27*a* toward the outer panel 12. Since the individual front walls 28 are joined to the support side wall 25 in an attitude in which they are orthogonal to the support side wall 25, the stiffness of the support side wall 25 can be enhanced, and collapse of the support side wall 25 can be prevented. The free end (end close to the outer panel 12) of the elastic wall 29 can be displaced in the fore-and-aft direction based on the action of a predetermined force.

Formed in the support side wall 25 are a pivot hole 31 with a cylindrical space that has a central axis on a rotational axis Rx parallel to the swing axis Sx of the operating handle 16, and an engagement recess 32 that opens on the outer panel 12 side at a position separated from the pivot hole 31 to the rear. An access path 33 opening on the outer panel 12 side and having a smaller width than the diameter of the pivot hole 31 is connected to the pivot hole 31. A rear wall of the engagement recess 32 is formed from a cylindrical face having a central axis on the rotational axis Rx. The support member 17 is disposed in a space sandwiched by the pair of support side walls 25 in front of the reference plane 26.

Figure 3:
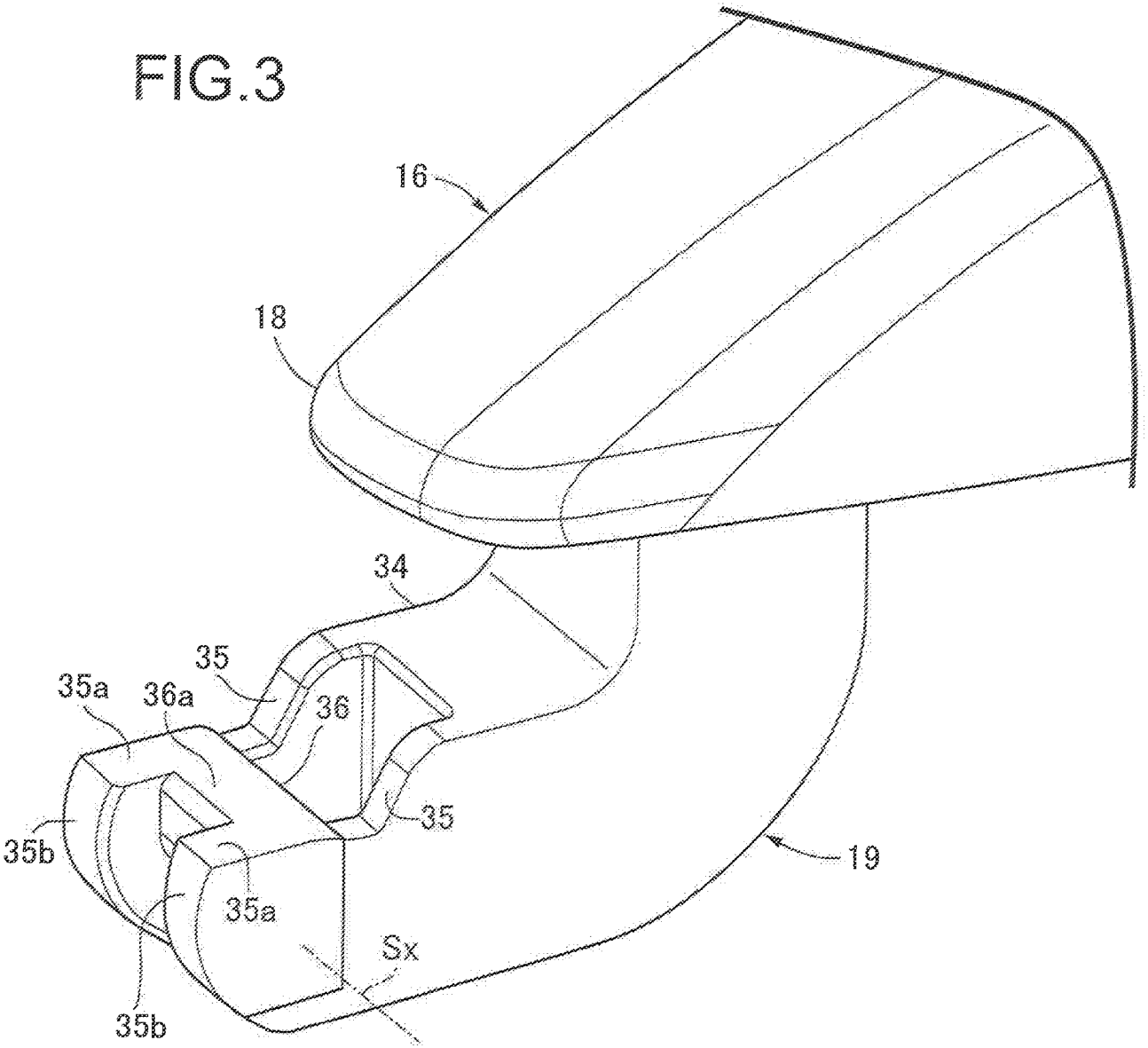
FIG. 3 is an enlarged perspective view schematically showing the structure of a support arm part of an operating handle.

The support arm part 19 of the operating handle 16 is formed integrally with the handle main body 21, enters the inside of the outer panel 12 from the outside of the outer panel 12, and bends forward in the inside of the outer panel 12. The support arm part 19 is disposed in a space sandwiched by the pair of support side walls 25. As shown in FIG. 3, the support arm part 19 includes one L-shaped arm main body 34 extending inward of the outer panel 12 and bending forward, a pair of wall bodies 35 extending forward from the front end of the arm main body 34 in parallel with each other with a gap therebetween along the swing axis Sx, and a support shaft 36 disposed with a gap from the front end of the arm main body 34, extending along the swing axis Sx between the wall bodies 35, and linking the wall bodies 35 to each other. Formed on the wall body 35 are a contact face 35*a* that is formed from a plane facing the outer panel 12 and extending in parallel with the swing axis Sx, and a pressing face 35*b* that is formed from a partial cylindrical face (specific curved face) formed at the front end of the wall body 35 and having a central axis on the swing axis Sx. A plane 36*a* is formed on the support shaft 36, the plane 36*a* being continuous from the contact face 35*a* and linking the contact faces 35*a* to each other.

Figure 4:
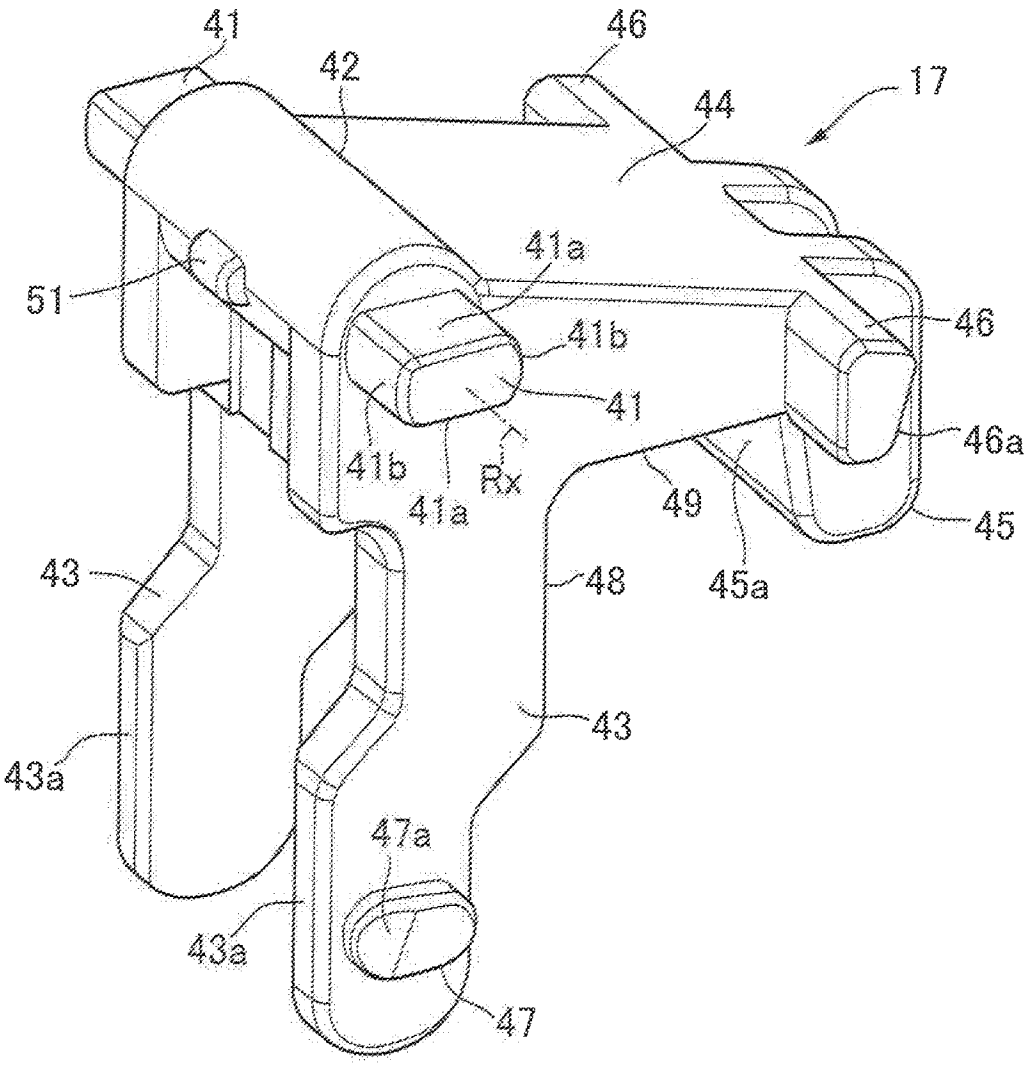
FIG. 4 is an enlarged perspective view schematically showing the structure of a support member.

The support member 17 has, as shown in FIG. 2, a pivoting base part 42 that has on opposite sides a rotary projection 41 supported by the pivot hole 31 of the support side wall 25 so as to be rotatable around the rotational axis Rx, and a pair of leg parts 43 that extend from the pivoting base part 42 so as to be away from the outer panel 12 between the pair of rotary projections 41, As shown in FIG. 5, inner ends of the leg parts 43 fit into and extend through the gap 58 (FIG. 7) formed between the linking bodies 27*a* and 27*b* of the base, and the leg parts are positioned by abutting against the front wall 28 of the base 14 via a front face 43*a* The support member also includes a barrel part 44 that extends from the pivoting base part 42 to the rear in a direction orthogonal to the leg part 43 around the rotational axis Rx, as well as a bearing part 45 that extends from the rear end of the barrel part 44 so as to be away from the outer panel 12 and supports the support shaft 36 via a bearing face 45*a*, and engagement projections 46 that project toward opposite sides at the rear end of the barrel part 44 and are received by the engagement recess 32 of the base 14. As shown in FIG. 4, the rotary projection 41 is partitioned by a pair of planes 41*a* that are separated from each other by the width of the access path 33 connected to the pivot hole 31 and are parallel to the rotational axis Rx, and a partial cylindrical face 41*b* that has a central axis on the rotational axis Rx, extends around the rotational axis Rx, and connects the planes 41*a* to each other. When the plane 41*a* is positioned in parallel with a movement path defined by the access path 33, the rotary projection 41 can pass through the access path 33 and move to and fro between the interior and the exterior of the pivot hole 31. The engagement projection 46 has a rear-facing abutment face 46*a* that extends along a virtual cylindrical face having a central axis on the rotational axis Rx so as to be supported on the rear wall of the engagement recess 32.

The leg part 43 of the support member 17 has a positioning projection 47 that projects outward from outer faces that face outward from each other. Formed on each positioning projection 47 is an inclined face 47*a* that goes closer to the outer face of the leg part 43 in going forward. The leg part 43 has elasticity so that it can be deformed so as to make open ends of the leg parts 43 go closer to each other. Therefore, the positioning projection 47 can move in the axial direction of the rotational axis Rx away from or closer to a virtual plane orthogonal to the rotational axis Rx according to an external force acting on the leg part 43. On the other hand, the leg part 43 has a rectangular cross-sectional shape that is long in the fore-and-aft direction orthogonal to the front face 43*a*, which is a flat plane, and has high stiffness in the peripheral direction around the rotational axis Rx.

The rear face of the leg part 43 has, as shown in FIG. 5, an abutment receiving face 48 that receives the pressing face 35*b* of the support arm part 19. When the operating handle 16 swings around the swing axis Sx, the pressing face 35*b* of the support arm part 19 continues to be in contact with the abutment receiving face 48 of the leg part 43. In this way, due to the front end of the support arm part 19 abutting against the abutment receiving face 48 of the support member 17, the support arm part 19 is sandwiched between the abutment receiving face 48 and the bearing face 45*a*, and rattling of the operating handle 16 in the fore-and-aft direction can be prevented. The bearing part 45 engages with the support shaft 36 formed at the front end of the support arm part 19 from the rear to thus restrict displacement of the support shaft 36 in the fore-and-aft direction. Even when an external force directed to the rear acts on the operating handle 16, since the rotary projection 41 is supported on the rear wall of the pivot hole 31 via the partial cylindrical face 41*b*, and the engagement projection 46 is supported on the rear wall of the engagement recess 32 via the abutment face 46*a*, rearward displacement of the support member 17 can reliably be restricted.

A bearing face 49 that faces inward with respect to the outer panel 12 and receives the contact face 35*a* of the support arm part 19 is provided on the barrel part 44 of the support member 17. The bearing face 49 covers the wall body 35 of the support arm part 19 from the outer panel 12 side, and restrains displacement of the support arm part 19 toward the outer panel 12. The swing axis Sx of the operating handle 16 is defined by the operation of the bearing part 45 of the support member 17 and the bearing face 49 of the barrel part 44.

As shown in FIG. 4, provided on the pivoting base part 42 is an attitude-retaining projection 51 that is formed integrally with the pivoting base part 42 and protrudes forward from the outer face of the pivoting base part 42. As described later the attitude-retaining projection 51 makes contact with the elastic wall 29 of the base 14 when the support member 17 pivots around the rotational axis Rx with respect to the base 14. When the elastic wall 29 maintains its original shape, the extremity of the elastic wall 29 is positioned on the trajectory of the attitude-retaining projection 51, and pivoting of the support member 17 is restricted in response to contact between the elastic wall 29 and the attitude-retaining projection 51. On the other hand, when an external force that causes elastic deformation of the elastic wall 29 acts on the support member 17, the attitude-retaining projection 51 pushes the elastic wall 29 away from its trajectory, and the support member 17 can pivot around the rotational axis Rx regardless of contact between the elastic wall 29 and the attitude-retaining projection 51.

As shown in FIG. 5, the base 14 has a restricting body (restricting part) 52 that is formed integrally with the base 14 so as to face the outer panel 12 and that makes contact with a restricting face 36*b* formed on the support shaft 36. As described later, the restricting body 52 makes contact with the restricting face 36*b* of the support arm part 19 when the operating handle 16 swings, and restricts displacement of the operating handle 16 in moving away inwardly from the outer panel 12. The restricting body 52 is supported by being integrally formed with a reinforcing body 53 that connects the front and rear linking bodies 27*a* and 27*b*.

Figure 6:
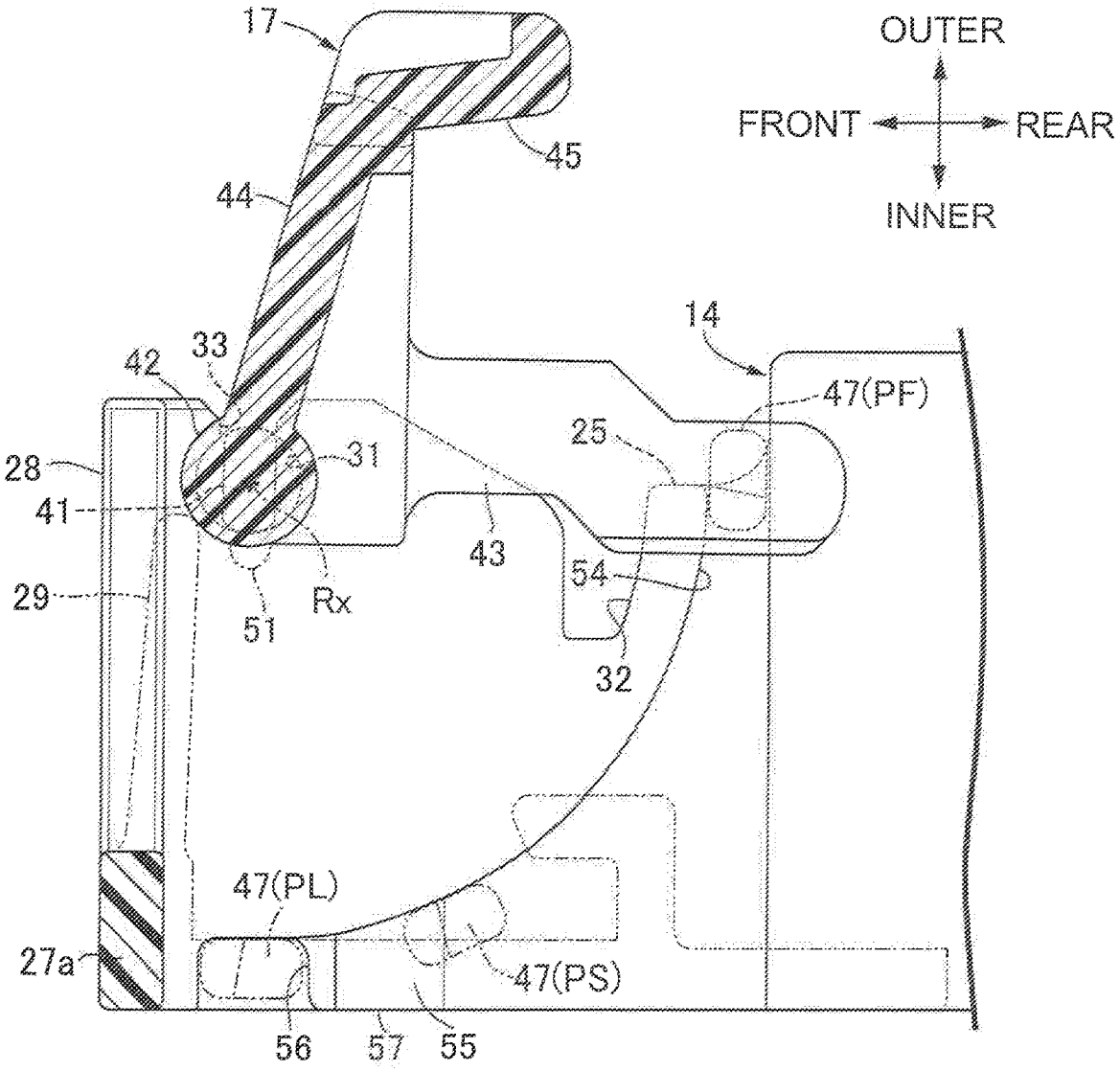
FIG. 6 is a conceptual diagram schematically showing movement of the support member around a rotational axis.

As shown in FIG. 6, a guideway 54 is formed on the base 14, the guideway 54 guiding movement of the positioning projection 47 along a movement path defined around the rotational axis Rx of the support member 17 so as to be coaxial with the rotational axis Rx. The positioning projection 47 is guided along the guideway 54 to an entry position PF that is established when the rotary projection 41 enters the pivot hole 31, a standby position PS that is established immediately after the attitude-retaining projection 51 passes through the extremity of the elastic wall 29 based on elastic deformation of the elastic wall 29, and an assembled position PL that is established when the support member 17 retains the support shaft 36 of the operating handle 16 at a predetermined position.

Figure 7:
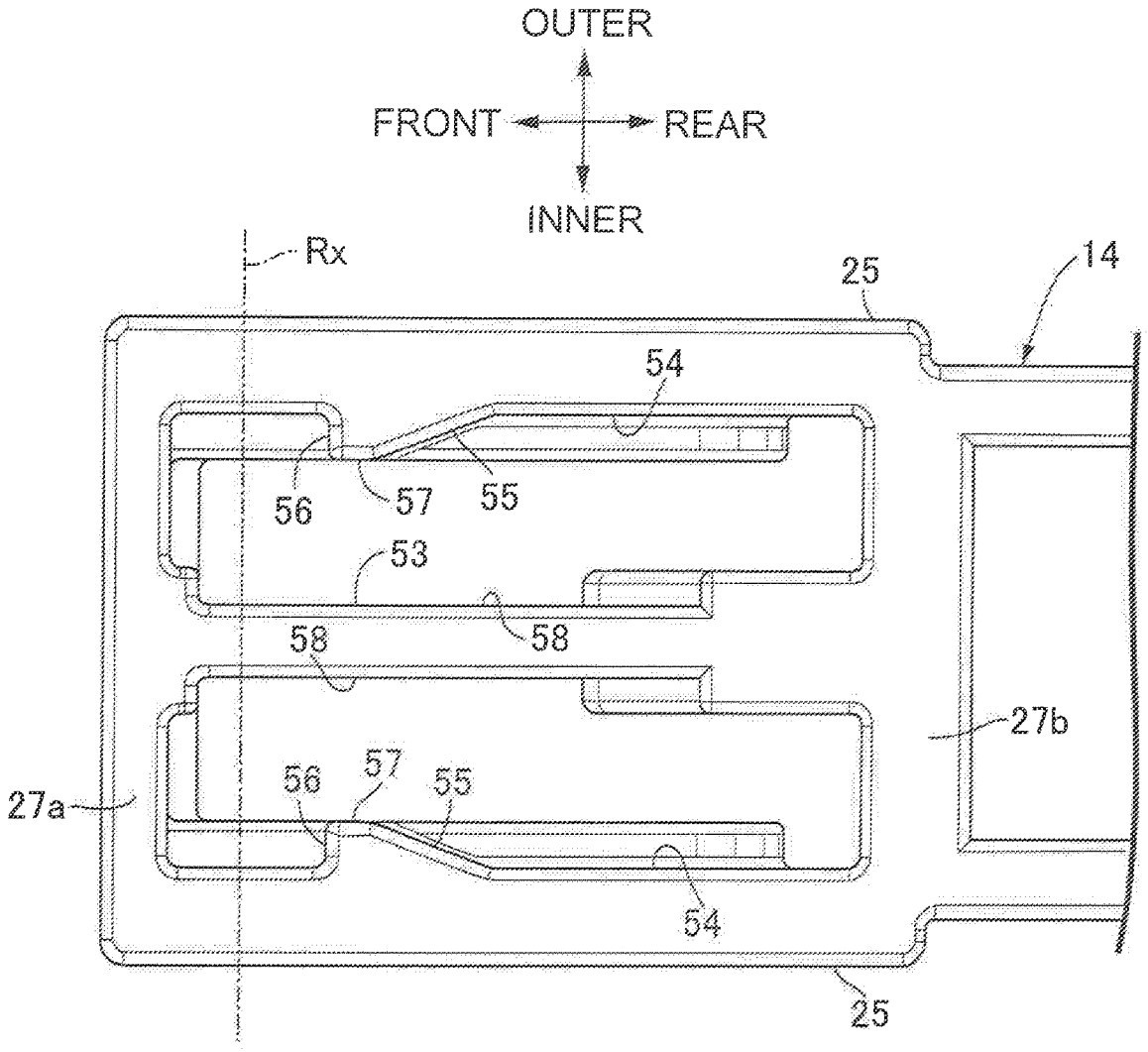
FIG. 7 is an enlarged partial side view of the base schematically showing the structure of a guideway of the base.

As shown in FIG. 7, the guideway 54 has a three-dimensional shape in the axial direction of the rotational axis Rx. That is, the guideway 54 is provided with a slope 55 so that displacement of the positioning projection 47 toward the assembled position PL is restricted at the standby position PS. Similarly, the guideway 54 is provided with a vertical wall 56 so that displacement of the positioning projection 47 from the assembled position PL toward the standby position PS or the entry position PF is restrained. The slope 55 and the vertical wall 56 are each formed on a projecting piece 57 that protrudes from inner wall faces of the support side wall 25 that face each other. Therefore, the slope 55 is formed on a plane that goes away from the inner wall face of the support side wall 25 in going forward. The vertical wall 56 is formed on a plane that faces the rear face of the front wall 28 and stands upright from the inner wall face of the support side wall 25. An opening 58 via which the leg part 43 of the support member 17 can be accessed is defined in the base 14 between the respective support side walls 25 and the reinforcing body 53.

The operation of the outer handle device 13 related to the present embodiment is now explained. As shown in FIG. 1, when the operating handle 16 is gripped by a hand of an operator and operated so as to move away from the outer panel 12, the operating handle 16 swings around the swing axis Sx up to the operated position, the door lock device is unlocked, and the vehicle door 11 is opened.

Figure 8:
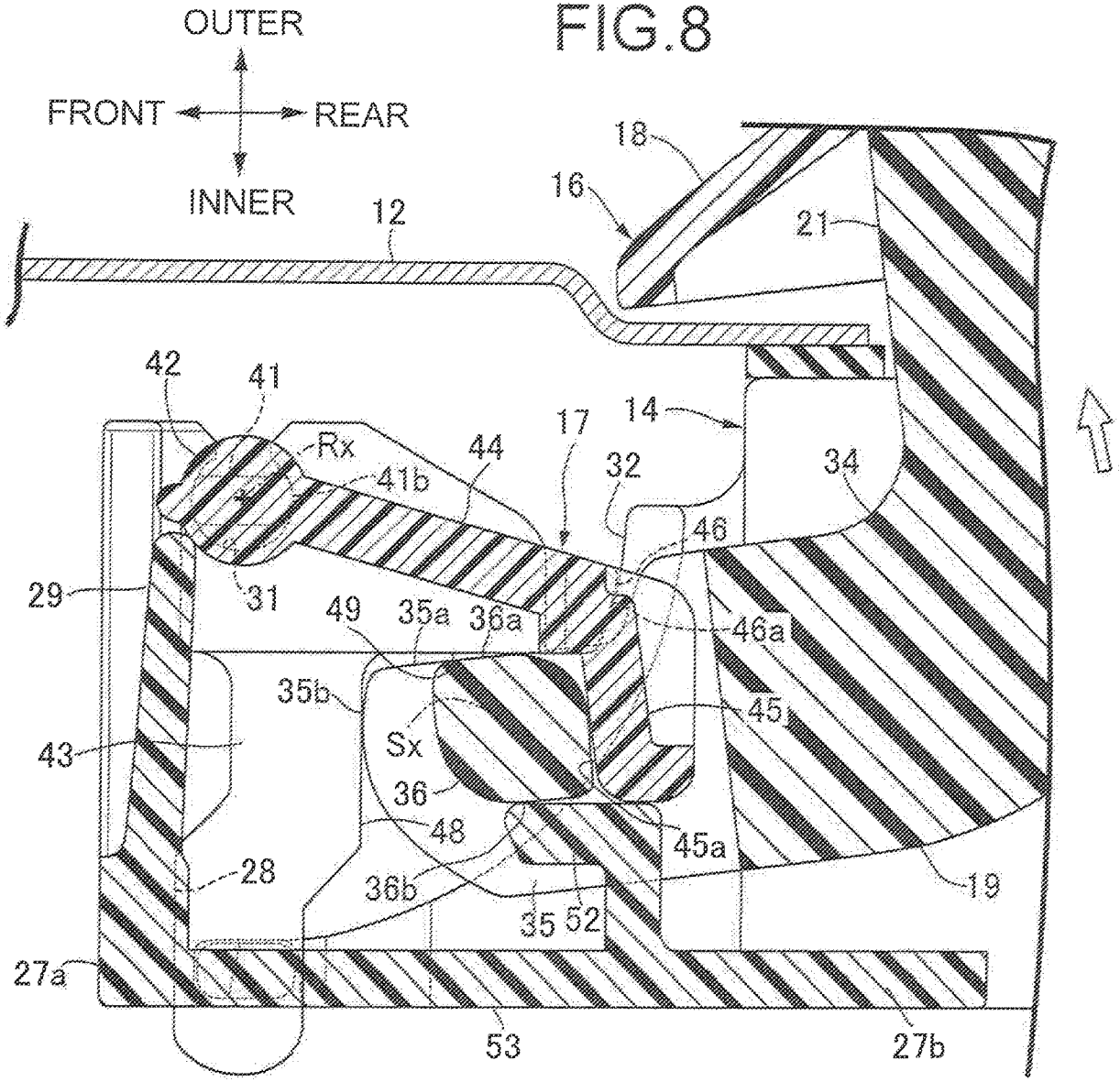
FIG. 8 is an enlarged horizontal sectional view, corresponding to FIG. 5, schematically showing movement of the support arm part with respect to the base and the support member when the operating handle is operated to an operated position.

As shown in FIG. 8, even when the operating handle 16 swings around the swing axis Sx, the pressing face 35*b* of the operating handle 16 maintains contact with the abutment receiving face 48 of the support member 17, the bearing part 45 of the support member 17 maintains contact with the support shaft 36 from the rear, the contact face 35*a* and the plane 36*a* of the operating handle 16 maintain contact with the bearing face 49 of the support member 17, and the restricting body 52 of the base 14 maintains contact with the restricting face 36*b* of the operating handle 16. Therefore, fore-and-aft movement of the operating handle 16 is restrained by the abutment receiving face 48 and the bearing part 45 of the support member 17, displacement of the support shaft 36 toward the outer panel 12 is restrained by the support member 17, and displacement of the support shaft 36 that moves away inwardly from the outer panel 12 is restrained by the base 14. In this way, when the operating handle 16 is operated so as to move away outwardly from the outer panel 12, even if a force directed inward of the outer panel 12 acts on the support arm part 19 of the operating handle 16, since displacement of the support arm part 19 is supported by the restricting body 52, rattling of the operating handle 16 can reliably be prevented.

In this process, the restricting body 52 is formed integrally with the base 14 so as to face the outer panel 12 and makes contact with the restricting face 36*b* formed on the support shaft 36. In this way, since the restricting body 52 is formed integrally with the base 14, addition of another member is not required for installing the restricting body 52, and any increase in the number of components can be avoided.

In the outer handle device 13, the base 14 includes the pair of support side walls 25 disposed on opposite sides of the support member 17 and swingably supporting the support member 17 between the standby position and the assembled position, the pair of front and rear linking bodies 27*a* and 27*b* disposed with a gap therebetween in the fore-and-aft direction and connecting the support side walls 25 to each other, and the reinforcing body 53 connecting the linking bodies 27*a* and 27*b* to each other and supporting the restricting body 52. In this way, since support of the restricting body 52 is reinforced by the reinforcing body 53, it is possible to prevent the restricting body 52 from being broken.

Figure 9:
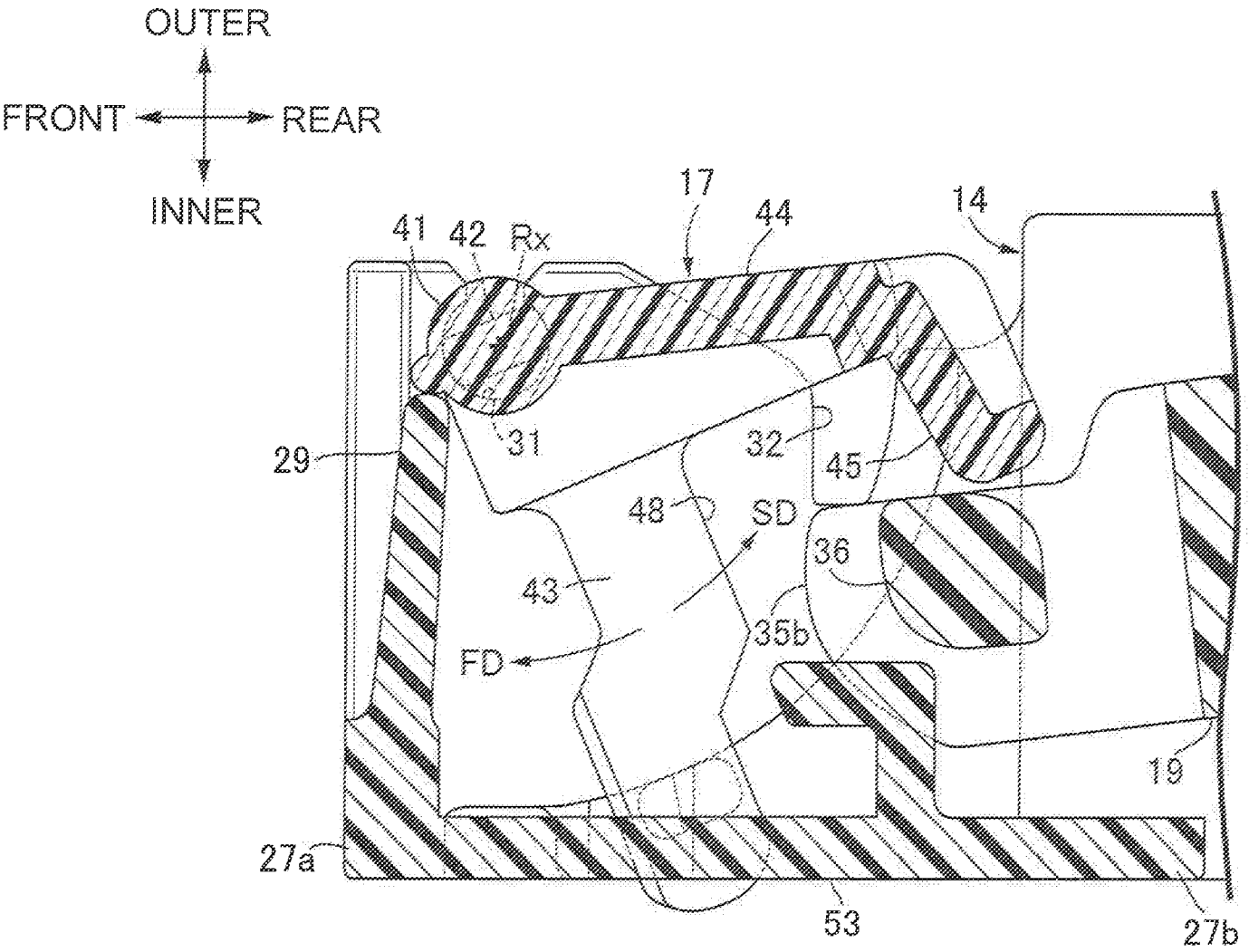
FIG. 9 is an enlarged horizontal sectional view, corresponding to FIG. 5, schematically showing the support member at a standby position.

A method for assembling the outer handle device 13 is now explained. The outer handle device 13 is assembled onto the outer panel 12 of the vehicle door 11. When carrying out assembly, the base 14 is mounted on the outer panel 12 from the inside of the outer panel 12. Subsequently, the operating handle 16 is linked to the base 14 from the outside of the outer panel 12. When carrying out linking, the support arm part 19 of the operating handle 16 passes through the opening of the outer panel 12 and is inserted into a space sandwiched between the support side walls 25. In this process, the support member 17 is provisionally fitted to the base 14 in advance. In this provisional fitting, as shown in FIG. 9, the positioning projection 47 of the support member 17 is positioned at the standby position around the rotational axis Rx. Since the inclined face 47*a* of the positioning projection 47 is in contact with the slope 55 of the guideway 54, displacement of the positioning projection 47 toward the assembled position PL is restrained. As a result, rotation of the support member 17 around the rotational axis Rx in a first direction FD is restricted. On the other hand, since the attitude-retaining projection 51 makes contact with the elastic wall 29 from the outer panel 12 side, displacement of the positioning projection 47 toward the entry position PF is restrained. As a result, rotation of the support member 17 around the rotational axis Rx in a second direction SD that is opposite to the first direction FD is restricted. In this way, the support member 17 is retained in a specific attitude around the rotational axis Rx on the base 14.

When the support arm part 19 of the operating handle 16 moves forward on the base 14, the pressing face 35*b* of the support arm part 19 abuts against the abutment receiving face 48 of the support member 17. When an external force further acts on the operating handle 16 in the forward direction, the positioning projection 47 moves up on the slope 55 and causes elastic deformation of the leg part 43, thus allowing the support member 17 to swing around the rotational axis Rx in the first direction FD. When the front face of the leg part 43 abuts against the front wall 28 of the base 14, the positioning projection 47 reaches the assembled position PL. The bearing part 45 of the support member 17 covers the support shaft 36 of the support arm part 19 from the rear. Since the vertical wall 56 of the projecting piece 57 makes contact with the rear end of the positioning projection 47, rotation of the support member 17 around the rotational axis Rx in the second direction SD is prevented. The support member 17 is thus fitted to the base 14.

What is claimed is:

1. An outer handle device configured to be installed on a vehicle door, said outer handle device comprising:

a base that is configured to be mounted on an outer panel of the vehicle door from an inside of the outer panel, an operating handle that is configured to be disposed on an outside of the outer panel and includes a support arm part having a support shaft extending along a swing axis of the support arm part, the support arm part configured to enter the inside of the outer panel from the outside of the outer panel, and a support member that is fitted to the base, engages with the support arm part from a rear side of the support arm part, and retains displacement of the operating handle in at least a vehicle fore-and-aft direction, wherein the base comprises:

a pair of support side walls that are disposed on opposite sides of the support member and support the support member therebetween so as to be pivotally movable about a rotational axis between a standby position and an assembled position, a pair of front and rear linking bodies that are disposed across a gap therebetween in a fore-and-aft direction and connect the support side walls to each other, a restricting part that faces the outer panel in an installed configuration of the outer handle device, the restricting part contacting a restricting face formed on the support shaft, and a reinforcing body that connects the linking bodies to each other and supports the restricting part, wherein an inner portion of the support member fits into the gap formed between the linking bodies of the base, and wherein the restricting part is configured to make contact with the support arm part of the operating handle when the operating handle swings during operation thereof, thus restricting displacement of the operating handle in moving away inwardly from the outer panel in the installed configuration of the outer handle device.

2. The outer handle device according to claim 1, wherein the support member includes a barrel part, a pivoting base part disposed in front of the barrel part and having two rotary projections extending outwardly on opposite sides thereof, and at least one engagement portion extending outwardly from a rear part of the barrel part in a direction parallel to one of the rotary projections.

3. The outer handle device according to claim 2, wherein:

the base comprises a cantilevered elastic wall disposed between the side walls thereof, and the support member further comprises an attitude-retaining projection that is formed integrally with, and protrudes forwardly from a front face of the pivoting base part of the support member, the attitude-retaining projection configured to selectively contact an end portion of the cantilevered elastic wall.

4. The outer handle device of claim 2, wherein each of the side walls of the base has a pivot hole formed therein for receiving one of the rotary projections of the support member, and wherein at least one of the side walls has an engagement recess formed therein for selectively receiving the engagement projection of the support member.

5. The outer handle device for a vehicle door according to claim 1, wherein the support shaft has a cross-sectional shape along a plane perpendicular to the swing axis with opposed flattened portions, one of said flattened portions defining a restricting face.

6. An outer handle for a vehicle door, said outer handle device comprising:

a base that is configured to be mounted on an outer panel of the vehicle door from an inside of the outer panel, the base comprising a pair of spaced-apart support side walls;

an operating handle that is configured to be disposed outside of the outer panel, the operating handle comprising a support arm part configured to enter inside of the outer panel from outside of the outer panel, the support arm part having a support shaft extending along a swing axis and having a cross-sectional shape, along a plane perpendicular to the swing axis, with opposed flattened portions, one of said flattened portions defining a restricting face, and a support member that is fitted to the base between the side walls, engages with the support arm part from a rear side of the support arm part, and retains displacement of the operating handle in at least a vehicle fore-and-aft direction, wherein the support member is pivotally movable around a rotational axis which is parallel to and spaced away from the swing axis, the base being provided with a restricting part that is configured to be contacted by the support arm part of the operating handle when the operating handle swings during operation thereof, thus restricting displacement of the operating handle in moving away inwardly from the outer panel.

7. The outer handle for a vehicle door according to claim 6, wherein the restricting part is formed integrally with the base so as to face the outer panel in the installed configuration of the outer handle, and wherein the restricting part is in contact with a restricting face formed on the support shaft.

8. The outer handle for a vehicle door according to claim 6, wherein the support member is disposed between the support side walls and supported so as to be pivotally movable about the rotational axis between a standby position and an assembled position.

9. The outer handle for a vehicle door according to claim 8, wherein the base further comprises a pair of front and rear linking bodies that are disposed across a gap in a fore-and-aft direction, the linking bodies connecting the support side walls to each other, and a reinforcing body that connects the linking bodies to each other and supports the restricting part.

10. The outer handle for a vehicle door according to claim 6, wherein the support member includes a barrel part, a pivoting base part in front of the barrel part and having two rotary projections extending outwardly on opposite sides thereof, and at least one engagement portion extending outwardly from a rear part of the barrel part in a direction parallel to one of the rotary projections.

11. The outer handle according to claim 10, wherein:

the base comprises a cantilevered elastic wall disposed between the side walls, and the support member further comprises an attitude-retaining projection that is formed integrally with, and protrudes forwardly from a front face of the pivoting base part, the attitude-retaining projection configured to selectively contact an end portion of the cantilevered elastic wall during operation of the handle.

12. The outer handle of claim 10, wherein each of the side walls has a pivot hole formed therein for receiving one of the rotary projections of the support member, and wherein at least one of the side walls has an engagement recess formed therein for selectively receiving the engagement projection of the support member.

13. The outer handle for a vehicle door according to claim 6, wherein an inner portion of the support member fits into the gap formed between the linking bodies of the base.

14. An outer handle for a vehicle door, said outer handle device comprising:

a base that is configured to be mounted on an outer panel of the vehicle door from an inside of the outer panel, the base comprising a pair of spaced-apart support side walls, the base comprising a pair of front and rear linking bodies that are disposed across a gap in a fore-and-aft direction, the linking bodies connecting the support side walls to each other, and a reinforcing body that connects the linking bodies to each other;

an operating handle that is configured to be disposed outside of the outer panel, the operating handle comprising a support arm part configured to enter inside of the outer panel from outside of the outer panel, and a support member that is fitted to the base between the side walls, engages with the support arm part from a rear side of the support arm part, and retains displacement of the operating handle in at least a vehicle fore-and-aft direction, wherein the support member is pivotally movable around a rotational axis which is parallel to and spaced away from the swing axis, the base being provided with a restricting part that is integrally attached to the reinforcing body, the restricting part configured to be contacted by the support arm part of the operating handle when the operating handle swings during operation thereof, thus restricting displacement of the operating handle from moving away inwardly from the outer panel, and wherein an inner portion of the support member fits into the gap formed between the linking bodies of the base.

* * * * *